United States Patent [19]

Anderson

[11] 4,060,859

[45] Dec. 6, 1977

[54] MALE URINATING AID

[76] Inventor: Joseph B. Anderson, 19936 Moenart St., Detroit, Mich. 48212

[21] Appl. No.: 703,186

[22] Filed: July 7, 1976

[51] Int. Cl.[2] ..... E03D 13/00

[52] U.S. Cl. ..... 4/102; 4/109; 4/DIG. 5

[58] Field of Search ..... 4/1, DIG. 5, 251, 239, 4/249, 149, 153, 154, 99, 102, 109; 128/283

[56] References Cited

U.S. PATENT DOCUMENTS

| | | | |
|---|---|---|---|
| 2,577,028 | 12/1951 | Mc Morrow | 4/DIG. 5 |
| 2,791,780 | 5/1957 | Krischer | 4/DIG. 5 |
| 3,193,845 | 7/1965 | Funk | 4/1 |
| 3,490,082 | 1/1970 | Murcott | 4/239 |
| 3,516,095 | 6/1970 | Clifton | 4/251 |

*Primary Examiner*—Richard E. Aegerter
*Assistant Examiner*—L. Footland
*Attorney, Agent, or Firm*—Robert G. Mentag

[57] ABSTRACT

An accessory mountable on a toilet, so as to prevent males, during urination, from urinating on a floor or on the toilet; the accessory including a cylindrical shaped shield made of plastic or rubber, and which is accordion pleated, so as to collapse and fold underneath the toilet seat, the shield being upwardly extendable by means of operation of a foot pedal, and which in its upward extended position shields against urine splashing outwardly from the toilet.

2 Claims, 4 Drawing Figures

Fig. 1
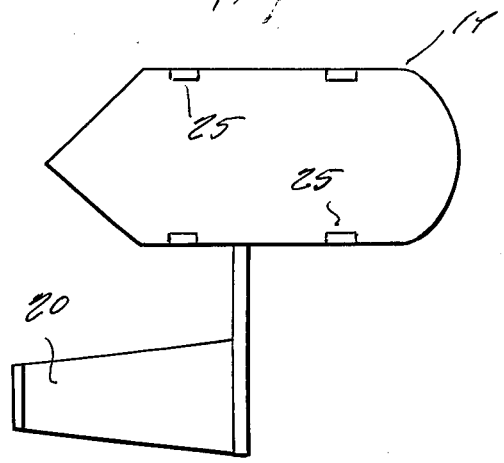
Fig. 2
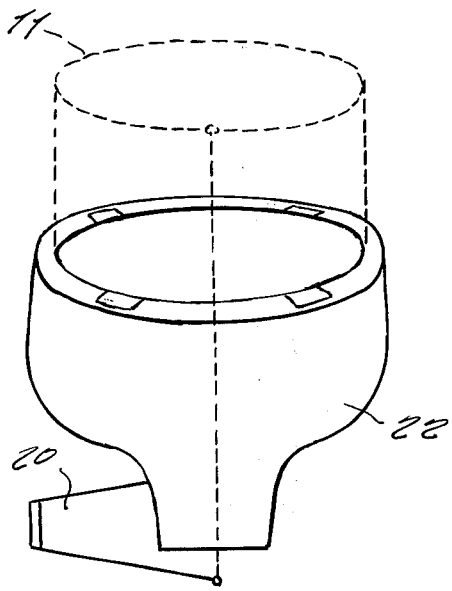
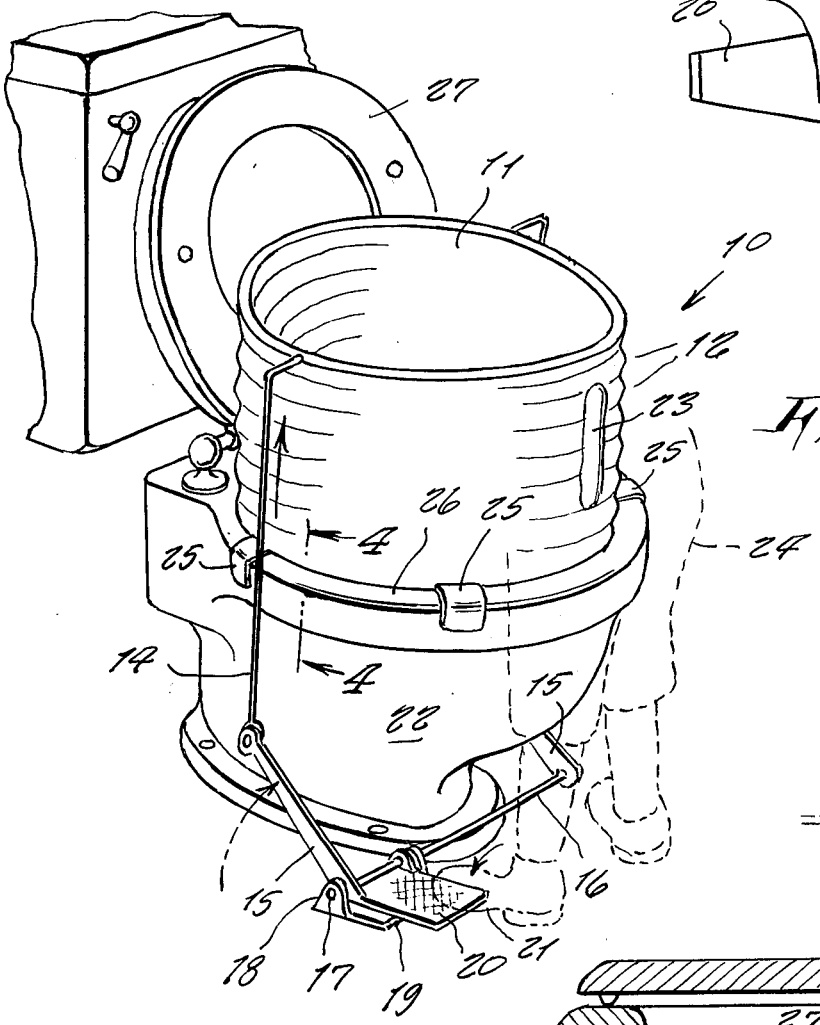
Fig. 3
Fig. 4
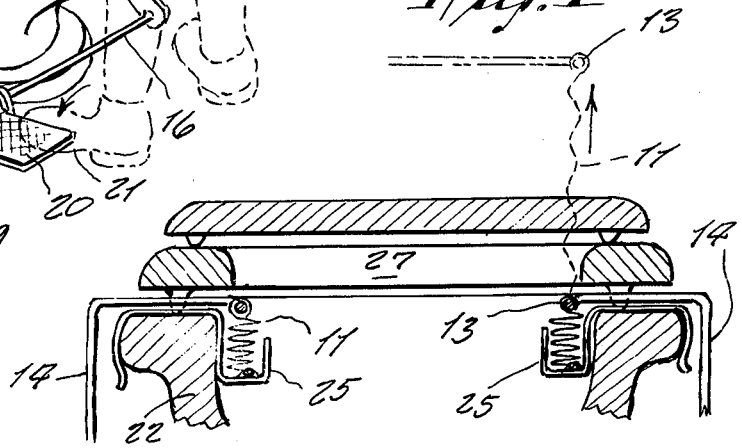

MALE URINATING AID

This invention relates generally to toilet antisplash guards.

A principal object of the present invention is to provide a shield to prevent males, during urination, from urinating on a floor or a toilet, and preventing splashing outwardly from the toilet bowl.

Another object is to provide a male urinating aid, that forms a vertical extension on top of the toilet, so as to form a higher circular enclosure.

Still another object is to provide a male urinating aid, which in a non-use, folds underneath the toilet seat, so as to be out of the way, and which will not interfere with other uses of the toilet.

Still a further object of the present invention is to provide a male urinating aid, wherein the shield includes a narrow vertical slit at its front, so as to accommodate small boys who cannot reach over the top of the shield for urinating purposes.

Still a further object is to provide a male urinating aid, which is foot operated between a collapsed and an upwardly extending position.

Other objects are to provide a male urinating aid, which is simple in design, inexpensive to manufacture, rugged in construction, easy to use and efficient in operation.

These and other objects will be readily evident upon a study of the following specification and the accompanying drawing, wherein:

FIG. 1 is a diagram of the present invention;

FIG. 2 is a diagrammatic perspective view thereof, shown raised over a toilet;

FIG. 3 is a perspective view thereof, shown in greater detail, and showing the foot pedal in downwardly operative position;

FIG. 4 is a cross-sectional view taken on line 4—4 of FIG. 3, and showing brackets designed to support the shield when in a folded downwardly position, in order to not hang down into the toilet, and at a same time not interferring with closing the toilet seat.

Reference is now made to the drawing in greater detail, wherein the reference numeral 10 represents a male urinating aid, according to the present invention, and which includes a cylinder 11, made either of plastic or rubber material, that is flexible and which is made with accordion pleats 12, so that the cylindrical shield can be readily collapsed from the position shown in FIG. 3, to the position shown in FIG. 4.

The upper edge of the cylindrical shield is stiffened by means of a circular wire 13 being rolled up within the edge, the wire being stiff, and which is connected pivotally free to diametrically opposite ends to a pair of downwardly extending links 14, which at their lower ends are pivotally attached to levers 15, rigidly affixed to a horizontally extending shaft 16, that is supported pivotally free within bearing openings 17 of upwardly extending lugs 18 of a stationary base plate 19. The shaft 16 and one of the levers 15 are, additionally, integral with a foot pedal 20, positioned above the base plate, and which can be downwardly pushed by means of a foot 21 of a male. The foot pedal extends dorwardly, and is located forwardly of a toilet 22, and is positioned slightly toward one side thereof, so that one foot of the person can be readily placed thereupon, while standing directly in front of the toilet.

A vertical slit 23 is formed through a front side of the shield 11, so that a small boy 24, who is not tall enough to reach over the upper edge of the shield, can thus utilize the slit 23, in order to urinate therethrough, and into the interior of the shield.

The shield collapses downwardly normally, due to its own weight, and in its downwardly collapsed position comes to rest upon a plurality of four brackets 25, installed around the toilet upper edge 26, thus preventing the collapsed shield from dropping down into the toilet lower portion. As shown in FIG. 4, it will be readily noted that the shield, in its collapsed position does not interfere with the seat 27 lowered downwardly upon the upper edge 26 of the toilet.

In installing the present invention, the brackets 25 can be readily and easily snapped over the toilet with the shield being rested in collapsed position upon the brackets. The base plate 19 can be readily affixed upon a floor in any suitable manner. Thus, the device can be quickly and easily installed or removed.

While various changes may be made in the detail construction, it is understood that such changes will be within the spirit and scope of the present invention as is defined by the appended claims.

What I claim is:

1. A male urinating aid for use with a toilet having a toilet bowl and a seat, comprising in combination, a cylindrical shield made of resilient material, said shield being made to incorporate accordion pleats so that said shield is readily collapsible by gravity to a collapsed inoperative position, means for mounting said shield inside the toilet bowl in said collapsed position beneath the toilet seat; and means for raising the shield from the collapsed inoperative position to a raised operative position above the toilet bowl said means for raising the shield including a circular stiff wire secured to the upper edge of said shield, the diametrically opposite sides of said circular wire being pivotally attached to the upper ends of a pair of downwardly extending links, lower ends of said links being pivotally attached to a pair of levers pivotable about a fulcrum means on a base plate, and said levers being integral with a foot pedal for being downwardly depressed to raise said shield to the raised operative position; and wherein the front end of said shield includes a vertical slit; and wherein said means for mounting the shield inside the toilet bowl includes a plurality of brackets mountable over an upper edge of the toilet bowl, said brackets supporting said shield when in a collapsed inoperative position.

2. The combination as set forth in claim 1, wherein a lower edge of said shield is secured to said brackets.

* * * * *